US009067776B2

(12) United States Patent
Soto

(10) Patent No.: US 9,067,776 B2
(45) Date of Patent: Jun. 30, 2015

(54) LIQUID DELIVERY SYSTEM FOR CLIMATE CONTROLLED FLUID CHAMBER

(71) Applicant: Jose Soto, Stephenville, TX (US)

(72) Inventor: Jose Soto, Stephenville, TX (US)

( * ) Notice: Subject to any disclaimer, the term of this patent is extended or adjusted under 35 U.S.C. 154(b) by 211 days.

(21) Appl. No.: 13/855,727

(22) Filed: Apr. 3, 2013

(65) Prior Publication Data

US 2014/0299631 A1 Oct. 9, 2014

(51) Int. Cl.
*B67D 7/80* (2010.01)

(52) U.S. Cl.
CPC ..... *B67D 7/80* (2013.01)

(58) Field of Classification Search
CPC ..... B67D 7/80
USPC ..... 222/146.1, 146.6, 152, 190, 192, 53; 454/173, 183, 341, 343, 344, 350
See application file for complete search history.

(56) References Cited

U.S. PATENT DOCUMENTS

| | | | | | |
|---|---|---|---|---|---|
| 1,438,450 | A | * | 12/1922 | Maki | 165/72 |
| 1,795,644 | A | * | 3/1931 | Dunlap | 165/45 |
| 1,977,831 | A | * | 10/1934 | Marshall et al. | 222/131 |
| 2,284,905 | A | * | 6/1942 | Jackson | 34/72 |
| 2,838,077 | A | * | 6/1958 | Cooper | 141/82 |
| 4,804,118 | A | * | 2/1989 | Mullen et al. | 222/641 |
| 5,007,249 | A | * | 4/1991 | Van Druff, Jr. | 62/255 |
| 5,320,162 | A | * | 6/1994 | Seaman | 165/255 |
| 2011/0302935 | A1 | * | 12/2011 | Cur et al. | 62/66 |

* cited by examiner

*Primary Examiner* — Daniel R Shearer
*Assistant Examiner* — Nicholas J Weiss
(74) *Attorney, Agent, or Firm* — Warren V. Norred

(57) ABSTRACT

An apparatus for storing fluids in an exterior climate-controlled chamber. The chamber provides a climate controlled environment for one or more useful fluids without requiring interior living space for storage of such fluids. In certain embodiments, the chamber provides a mechanism for automatic delivery of fluids directly into the living space.

5 Claims, 3 Drawing Sheets

LIQUID DELIVERY SYSTEM FOR CLIMATE CONTROLLED FLUID CHAMBER

TECHNICAL FIELD OF THE INVENTION

The present disclosure relates generally to storage and delivery of fluids to laundry rooms and associated applications, particularly to certain systems and methods for protecting fluids from adverse weather while storing them in a convenient and space-efficient manner.

BACKGROUND OF THE INVENTION

A wide variety of liquids are known to be useful for a variety of purposes, particularly in laundry rooms, mechanic shops and restaurants. Such liquids include, but are not limited to detergents, solvents, lotions, medicines, beverages and fuels, to name a few. Users of these liquids often struggle to conveniently store them in such a way that they can be easily accessed and used.

SUMMARY OF THE INVENTION

The present disclosure provides a versatile apparatus for storing and delivering fluids in a convenient manner.

The apparatus disclosed herein allows for exterior storage of fluids in a climate-controlled environment without requiring expensive heating or air conditioning equipment. The apparatus makes use of existing heating and air conditioning mechanisms to provide a desirable storage environment. According to a principal embodiment, the conditions within a fluid storage chamber are regulated by the use of an air handling system operable to move climate-controlled air from a nearby source into the chamber when appropriate.

Other features and advantages of the present disclosure will be apparent to those of ordinary skill in the art upon reference to the following detailed description taken in conjunction with the accompanying drawings.

BRIEF DESCRIPTION OF THE DRAWINGS

For a better understanding of the disclosure, and to show by way of example how the same may be carried into effect, reference is now made to the detailed description along with the accompanying figures in which corresponding numerals in the different figures refer to corresponding parts and in which.

DETAILED DESCRIPTION OF THE INVENTION

While the making and using of various embodiments of the present disclosure are discussed in detail below, it should be appreciated that the present disclosure provides many applicable inventive concepts, which can be embodied in a wide variety of specific contexts. The disclosure is primarily described and illustrated hereinafter in conjunction with various embodiments of the presently-described systems and methods. The specific embodiments discussed herein are, however, merely illustrative of specific ways to make and use the disclosure and do not limit the scope of the disclosure.

Figure 1:
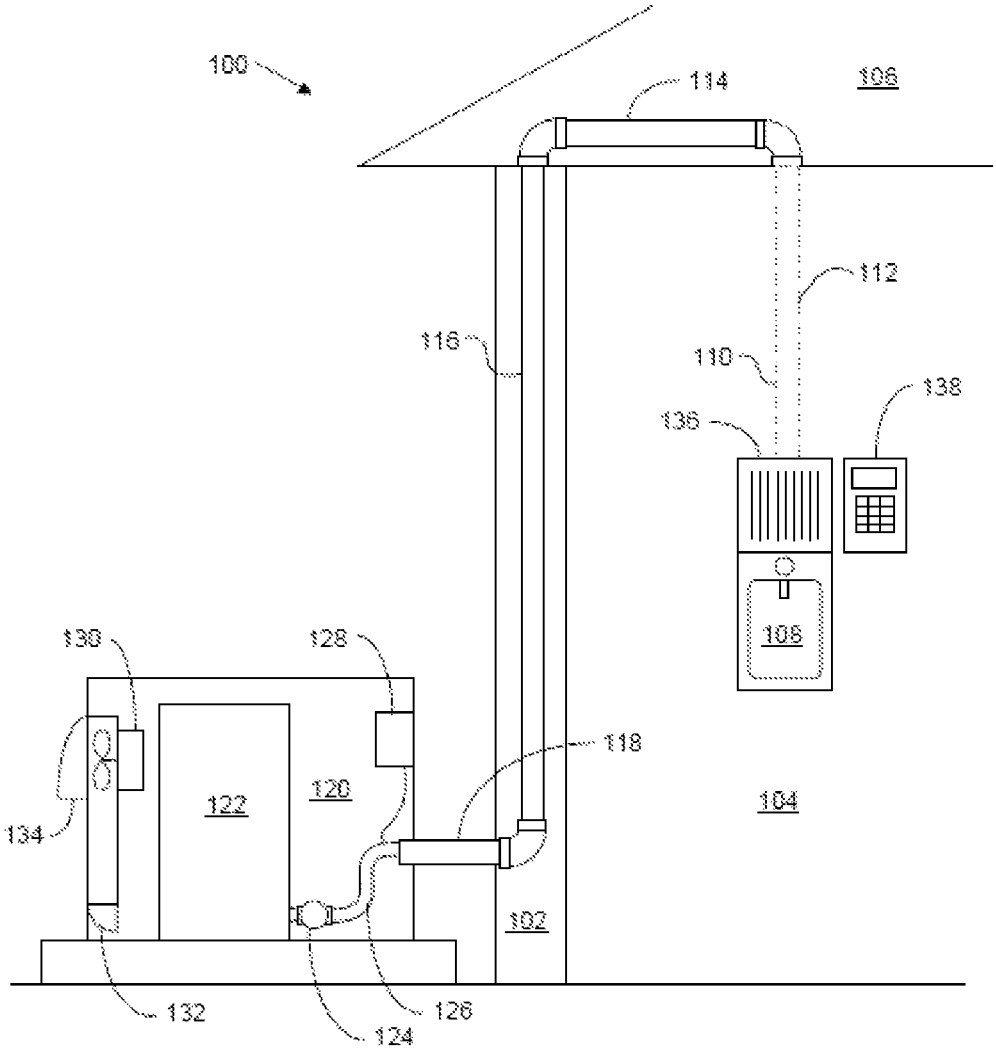
FIG. 1 depicts a side section view of a building showing the present fluid storage and delivery apparatus installed.
Figure 2:
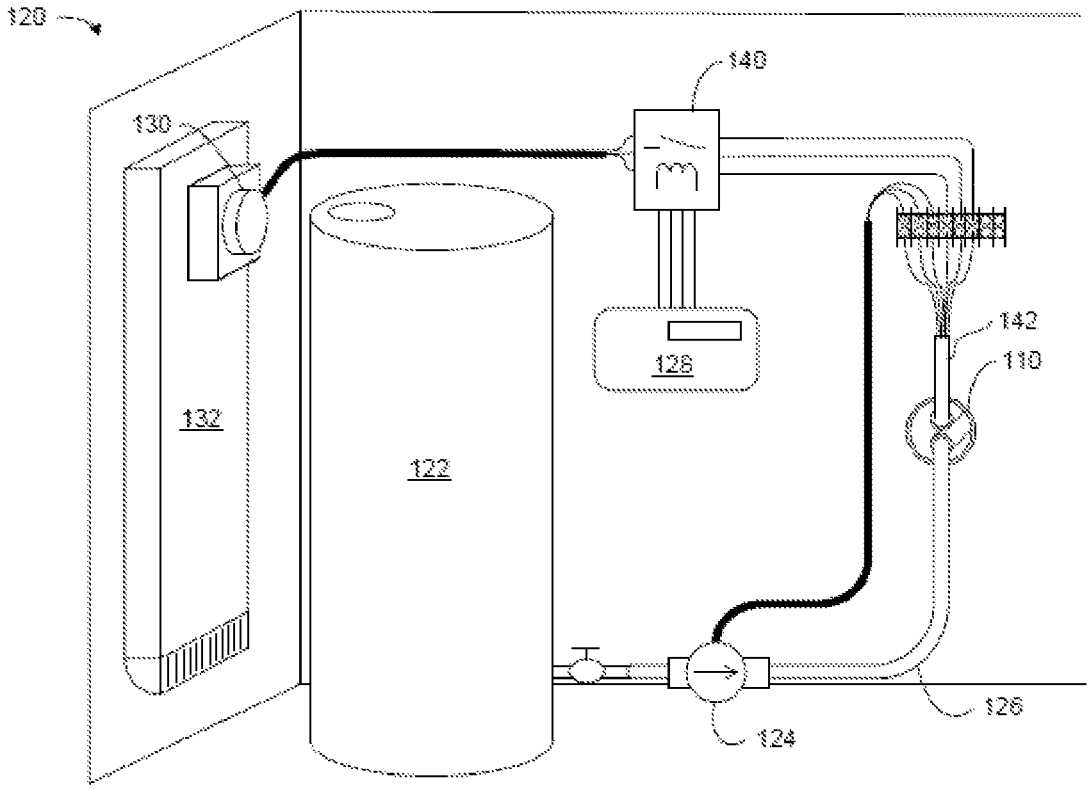
FIG. 2 depicts a detailed view of the inside of the climate-controlled chamber.
Figure 3:
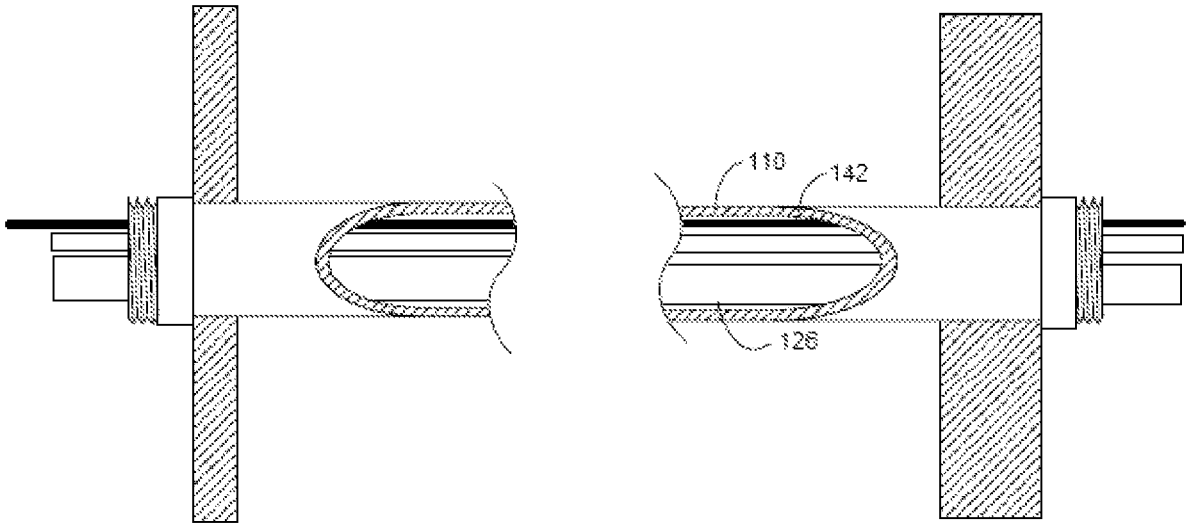
FIG. 3 depicts a detailed cutaway view of one embodiment of a conduit suitable for use with the present disclosure.

FIG. 1 depicts a building 100 comprising climate-controlled interior space 104 defined in part by exterior wall 102, and having attic space 106 disposed thereabove. FIG. 2 depicts a detailed view of an exterior fluid reservoir chamber 120. FIG. 3 depicts a detailed view of one embodiment of a conduit suitable for use with the present disclosure.

As can be seen in FIG. 1, an interior fluid dispenser 108, designed to provide convenient access to one or more fluids, is disposed within space 104. Fluids provided at the interior fluid dispenser 108 are delivered via a conduit 110 from a remote chamber 120 disposed outside of building 100. In this embodiment, conduit 110 comprises an interior vertical section 112, an interior transverse section 114, an exterior vertical section 116 and an exterior transverse section 118. Conduit 110 serves multiple functions, as discussed in detail below.

A fluid reservoir 122 is disposed within chamber 120 and connected to a fluid hose 126. A fluid pump 124 is disposed in fluid hose 126, in order to move fluid from fluid reservoir 122 to interior fluid dispenser 108. In certain embodiments, operation of fluid pump 124 may be controlled by a button or other manual control near or adjacent to interior fluid dispenser 108, but certain embodiments may employ an automatic pump control mechanism.

The temperature conditions within chamber 120 are controlled by a thermostat 128, set to maintain the temperature between a set high range and a set low range. Depending on the particular embodiment, the high and low temperature ranges may be hard-wired, or may be adjustable by a user or technician.

When the temperature within the exterior chamber 120 is outside of the target temperature range, thermostat 128 powers exhaust fan 130 via relay 140, which may be a separate component or an integral component of thermostat 128. Exhaust fan 130 is disposed within plenum 132 in such a manner as to impel air within plenum 132 out of plenum 132 via exhaust vent 134. This expulsion of air generates a negative pressure within chamber 120.

Chamber 120 is generally sealed except for the apertures at vent 134 and conduit 110. Thus, when a negative pressure is created by exhaust fan 130 within plenum 132, the drop in pressure in chamber 120 is communicated into and along conduit 110, through segments 118, 116, 114 and 112, to interior makeup vent 136. The negative pressure at interior makeup vent 136 draws climate-controlled air from interior space 104 to chamber 120 through interior makeup vent 136 and segments 112, 114, 116 and 118 of conduit 110. The replacement of out-of-range air in chamber 120 with climate-controlled interior air will bring the temperature within chamber 120 back within range, at which point the thermostat 128 will turn fan 130 off until the temperature of chamber 120 moves out of range again.

As noted above, conduit 120 provides multiple functions. In addition to serving as a conduit for liquid and air, conduit 120 may also carry electrical power and/or control signals via one or more cables such as cable 142. In the embodiment depicted in FIG. 1, the apparatus comprises a control panel 138, which may be employed to control conditions within chamber 120.

Similar embellishments, and various combinations thereof, are all comprehended by the present disclosure. In fact, all embodiments described herein are presented for purposes of illustration and explanation only. The specific compositions, configurations, orientations and operations of various features, portions and members may be provided in a number of ways in accordance with the present disclosure.

As an example of the manner in which the general teachings herein may be specifically employed, while the above disclosure has been presented in connection with a single reservoir holding one type of fluid, those of skill in the art will recognize that the teachings of the present disclosure may be employed in connection with multiple reservoirs holding multiple fluids. Further, although certain functionalities are represented herein by a single component for the sake of simplicity, those of skill in the art will recognize that the functions of a single component such as thermostat 128 may be performed by multiple separate components in certain embodiments. A particular embodiment may, for example, have a high temperature thermostat and a separate low temperature thermostat.

Thus, the embodiments and examples set forth herein are presented to best explain the present disclosure and its practical application and to thereby enable those skilled in the art to make and utilize the disclosure. As previously explained, those skilled in the art will recognize that the foregoing description and examples have been presented for the purpose of illustration and example only. The description as set forth is not intended to be exhaustive or to limit the disclosure to the precise form disclosed. Many modifications and variations are possible in light of the above teaching without departing from the spirit and scope of the following claims.

What is claimed is:

1. A climate-controlled fluid storage apparatus comprising:

a chamber having an internal volume filled with air having a temperature; a fluid reservoir disposed within the chamber suitable for storing a fluid; a fluid delivery hose connected at one end to a fluid delivery pump connected to the fluid reservoir and at the other end to a remote interior fluid dispensing unit; wherein the fluid reservoir is configured to exchange fluid with the interior fluid dispensing unit;

an exhaust fan disposed in such manner as to expel at least a portion of the air from the internal volume of the chamber;

a conduit connecting the internal volume of the chamber to a source of climate-controlled makeup air; and at least one thermostat having at least one temperature limit, operable to power the exhaust fan when the temperature of the air inside the chamber is outside of the temperature limit;

wherein the source of climate controlled makeup air comprises an interior makeup vent; and wherein the expelling at least a portion of the air from the internal volume of the chamber delivers a change in air pressure to the interior makeup vent.

2. The climate-controlled fluid storage apparatus of claim 1, wherein the source of climate controlled makeup air is an interior space of a building.

3. The climate-controlled fluid storage apparatus of claim 1, wherein the thermostat has an upper temperature limit and a lower temperature limit.

4. The climate-controlled fluid storage apparatus of claim 1, wherein the chamber is disposed outside of, and adjacent to, a climate-controlled building.

5. The climate-controlled fluid storage apparatus of claim 1, wherein the exhaust fan is disposed within an exhaust plenum disposed within the chamber.

* * * * *